US006102402A

United States Patent [19]

Scott et al.

[11] Patent Number: 6,102,402

[45] Date of Patent: Aug. 15, 2000

[54] BAD BEAT STUD

[76] Inventors: Mark Scott, 3878 Biltmore Bay St., Las Vegas, Nev. 89117; Bruce Henderson, P.O. Box 5047, Carefree, Ariz. 85377

[21] Appl. No.: 09/163,805

[22] Filed: Sep. 30, 1998

Related U.S. Application Data

[60] Provisional application No. 60/064,670, Oct. 14, 1997.

[51] Int. Cl.[7] ..... A63F 1/00

[52] U.S. Cl. ..... 273/292; 273/274

[58] Field of Search ..... 273/292, 274; 463/12, 13, 16

[56] References Cited

U.S. PATENT DOCUMENTS

| | | |
|---|---|---|
| 4,836,553 | 6/1989 | Suttle et al. . |
| 5,657,993 | 8/1997 | Merlino et al. . |
| 5,810,354 | 9/1998 | Banyai . |
| 5,845,906 | 12/1998 | Wirth . |
| 5,901,958 | 5/1999 | Andrews . |

*Primary Examiner*—William M. Pierce
*Attorney, Agent, or Firm*—John Edward Roethel

[57] ABSTRACT

Each player makes an initial ante wager and then each player and the dealer receive five cards face down. The player makes a "first" wager to see a sixth card and a "second" wager to see a seventh card. The sixth and seventh cards are each community cards used by each player and the dealer. Each player's hand is analyzed to see if the player has a qualifying hand of at least a pair of Deuces or better. If the player does not qualify, all wagers are lost by the player. If the player's hand does qualify, all cards of the dealer's hand are turned face up and each player's hand is compared to the dealer's hand using conventional poker hand ranking to determined whether the player's hand has a higher ranking five card poker hand than the dealer's hand. Each player also optionally may make a side bet wager to be eligible for special payouts, including a "bad beat" payout. The special payout can take either of two forms: 1) the player wins preselected payout amounts for poker hand rankings of at least a Four-of-a-Kind if the player's hand beats or ties the dealer's hand, or 2) the player wins other preselected and much higher amounts for poker hand rankings of at least a Straight or higher that the player achieves but the player's hand loses to the dealer's hand. Alternatively, the dealer's hand is analyzed to determine whether the dealer has a qualifying hand.

18 Claims, 4 Drawing Sheets

BAD BEAT STUD

CROSS-REFERENCE TO RELATED APPLICATIONS

This application is based on and is a Continuation-in-Part of application Ser. No. 60/064,670, filed Oct. 14, 1997, entitled "Bad Beat Stud", now pending.

This application relates to a casino card game, and more particularly to a casino card game based on seven card stud poker. The method of play involves a dealer's five card hand, one or more player's five card hands and two community cards. The players also have the opportunity to win special payouts for having a "bad beat" hand.

BACKGROUND OF THE INVENTION

Seven card stud poker has been played for many years. Each player receives seven cards and makes the best five card poker hand from these seven cards. The ranking of poker hands in seven card stud uses conventional poker hand rankings: Royal Flush, Straight Flush, Four-of-a-Kind, Full House, Flush, Straight, Three-of-a-Kind, Two Pair, One Pair and Highest Card.

Poker games using community cards have also been played for many years. These games generally fall into the family of games known as "Spit-in-the-Ocean" games. In these games each player is dealt one or more cards and the rest of the player's hand comes from community cards available to all players.

Perhaps the most popular community card game is Texas Hold-Em because of the large number of players who can play at one time and the fast action and large pots that are generated. The game is fast because only two cards are dealt to each player, with the remaining cards being dealt to a "flop" which forms the community cards from which each player makes up the rest of his hand. Each hand, however, has a single set of community cards which all players use as part of their poker hand. Therefore, the winning hand comes from that player whose two cards best fit with the community cards.

There are also many casino games which add to the conventional game an additional side bet so that a player can be eligible for a large jackpot. In CARIBBEAN STUD® Poker, a player can make a separate side bet wager to be eligible for special payouts. If the player has made the side bet wager and is dealt a Royal Flush, the player wins 100% of a progressive jackpot amount. This side bet feature is described in U.S. Pat. No. 4,861,041, the disclosure of which is incorporated herein. As described in this '041 patent, this side bet feature can also be applied to Twenty-One, conventional Draw Poker and other casino games.

In live poker room gaming, a plurality of players compete against one another. The house or game operator provides a dealer, the cards and a table to play the game. Typically, a small percentage of each pot (the "rake") is collected by the game operator as the fee for providing the dealer and the facilities.

Operators of live poker room gaming have used different types of inducements to encourage player participation. Besides free coffee and donuts, many operators also provide what is known as a "bad beat" jackpot. The operator makes a payment to a player who has an unusually high ranking poker hand, but loses the pot to another player with an even higher ranking poker hand.

In a typical "bad beat" jackpot situation, the operator of the poker room seeds a jackpot at some beginning level amount, say $1,000.00. The jackpot can remain as a fixed amount until won by a player or the jackpot can be a progressive amount which increases n each hour or day until won. The progressive jackpot can also increase based on the amount of play occurring at the poker table. For example, a portion of the "rake" can be used by the operator to increase the progressive amount of the "bad beat" jackpot.

In order to win the "bad beat" jackpot, a player must have a high ranking poker hand, but lose the regular game pot to another player. Typically, to be eligible for the "bad beat" jackpot, a player must have at least Aces Full of Tens (a Full House with three Aces and two Tens or better) and then lose the regular pot. Even though the player may have lost the regular pot, the player wins the "bad beat" jackpot which could be several thousand dollars. Often this "bad beat" jackpot is divided among all of the players at the table, with the player holding the "bad beat" hand winning the major portion of the jackpot.

As casino gaming proliferates throughout the United States and into foreign countries, there continues to be a need for more live casino games to attract and keep the interest of the players. In order to be successful, live casino games must be easy to play, but nevertheless exciting and should also provide the player with the opportunity to win a large payout.

It is the object of the present invention to provide a new, live casino table game that is easy to play, that will appeal to players and that offers the opportunity for a player to win a large jackpot.

It is a feature of the present invention that each player plays a seven card stud poker hand against a dealer's seven card stud poker hand. Each player and the dealer have their own five cards and two community cards are shared by each player and the dealer. Each player makes multiple wagers to continue to participate in the play of the game. If the player has a high ranking hand and still loses to the dealer, the player can win a "bad beat" payout.

It is an advantage of the present invention that the seven card stud game used in the method of play is easy to understand by most players and utilizes traditional poker hand rankings to determine winning card combinations. The use of multiple wagers during the play of the hand allows the player the opportunity to fold on poor hands and to increase his wager on better hands, thereby allowing the player to engage in money management techniques to improve his chance of winning. The "bad beat" feature also provides the player with the opportunity to win a large jackpot amount in a situation in which the player would otherwise have only a losing hand.

SUMMARY OF THE INVENTION

Each player makes an initial ante wager and then each player and the dealer receive five cards face down. The player makes a "first" wager to see a sixth card and a "second" wager to see a seventh card. The sixth and seventh cards are each community cards used by each player and the dealer. After all seven cards are dealt, each player's hand is analyzed to see if the player has a qualifying hand. In order for a player's hand to qualify, the player must have a minimum ranking hand which is to be determined mathematically. It is anticipated that this minimum raking hand will be at least a pair of Deuces or better in the seven cards used in the player's hand. If the player does not qualify, all wagers (except the side bet wager) made by each player are lost by the player to the gaming establishment including the "ante" wager, the "first" wager and the "second" wager.

If the player's hand does qualify, all cards of the dealer's hand are turned face up and each player's hand is compared to the dealer's hand to determined whether the player's hand has a higher ranking five card poker hand than the dealer's hand. Conventional poker hand rankings are used to determine the higher hand: Royal Flush, Straight Flush, Four-of-a-Kind, Full House, Flush, Straight, Three-of-a-Kind, Two Pair and One Pair.

The dealer and the player each use the best five card poker hand. If the player wins, he receives one-to-one odds on all of his wagers. If the player loses, he loses all three wagers. Tie hands are a push and all three wagers are returned to the player.

Each player also optionally may make a side bet wager to be eligible for special payouts, including a "bad beat" payout. If the player is "jackpot qualified" and the player has a predetermined poker hand ranking, the player wins a special payout. The special payout can take either of two forms: 1) the player wins preselected payout amounts for poker hand rankings of at least a Four-of-a-Kind or higher if the player's hand beats or ties the dealer's hand, or 2) the player wins other preselected and much higher amounts for poker hand rankings of at least a Straight or higher that the player achieves but the player's hand loses to the dealer's hand.

In an alternative variation of the method of play of the if present invention, the dealer's hand is analyzed to determine whether the dealer has a qualifying hand in order for the game to continue.

DETAILED DESCRIPTION OF THE PREFERRED EMBODIMENTS

The method of the present invention involves a seven card stud poker game combined with an optional side bet involving a "bad beat" feature. The object of the method of play is for each player to beat the dealer's hand. Each player and the dealer play a seven card stud poker hand. Each player and the dealer are dealt separate five card hands. Two community cards, the "turn" card and the "river" card, are used by all players and the dealer to complete the seven card hands. Each player and the dealer use the best five card poker hand of the total seven cards.

The "bad beat" feature comes into play when a player achieves a high ranking poker hand, but still loses to the dealer. When the player has a high ranking poker hand and suffers this "bad beat", the player wins all or a predesignated portion of a jackpot amount depending on the ranking of the poker hand held by the player. The jackpot amount can be either a fixed jackpot amount or a progressive jackpot amount.

Figure 1:
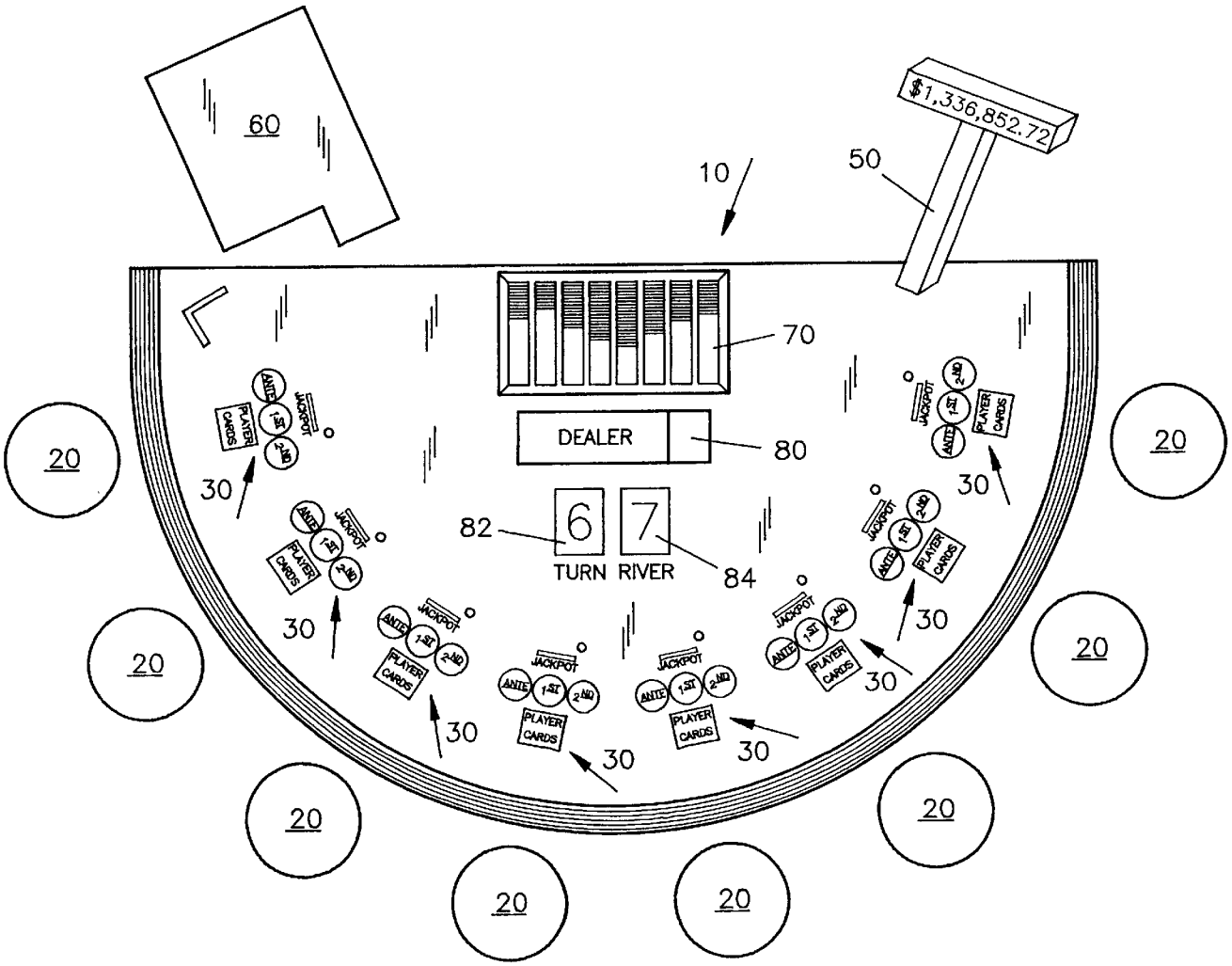
FIG. 1 shows the table layout used in the method of the play of the present invention.
Figure 2:
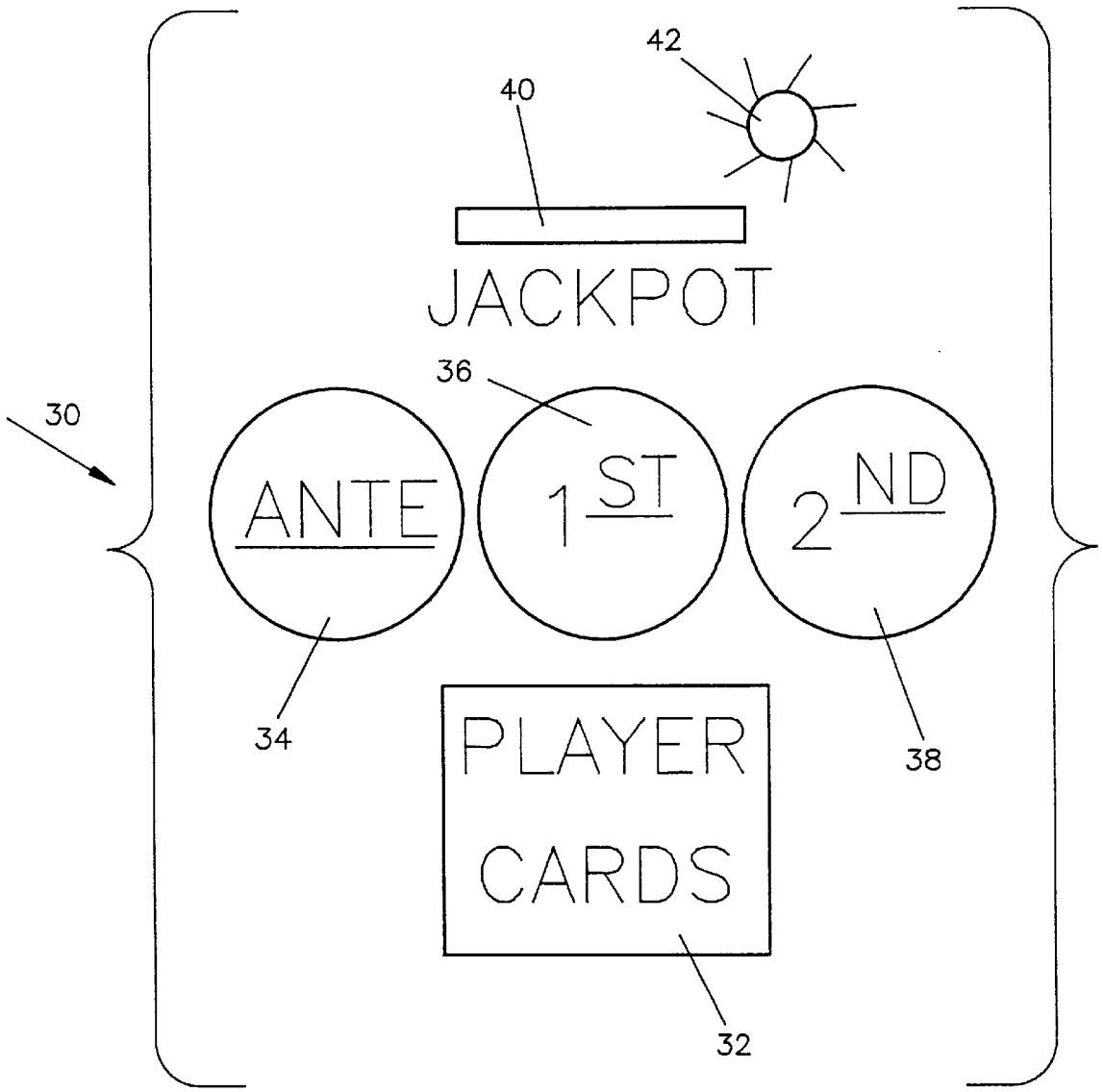
FIG. 2 shows an enlarged detail view of the table layout at a particular player location.
Figure 3:
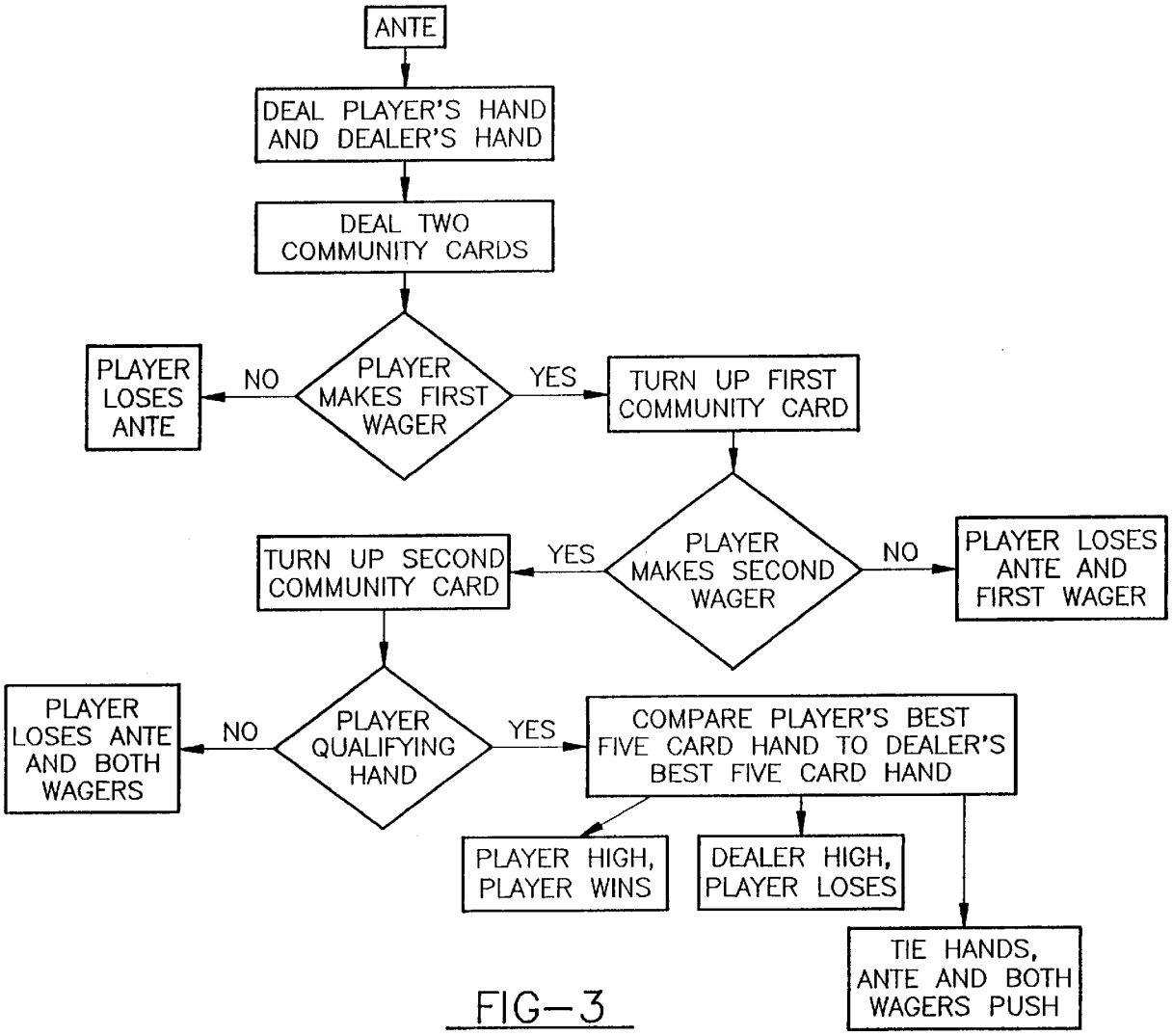
Figure 4:
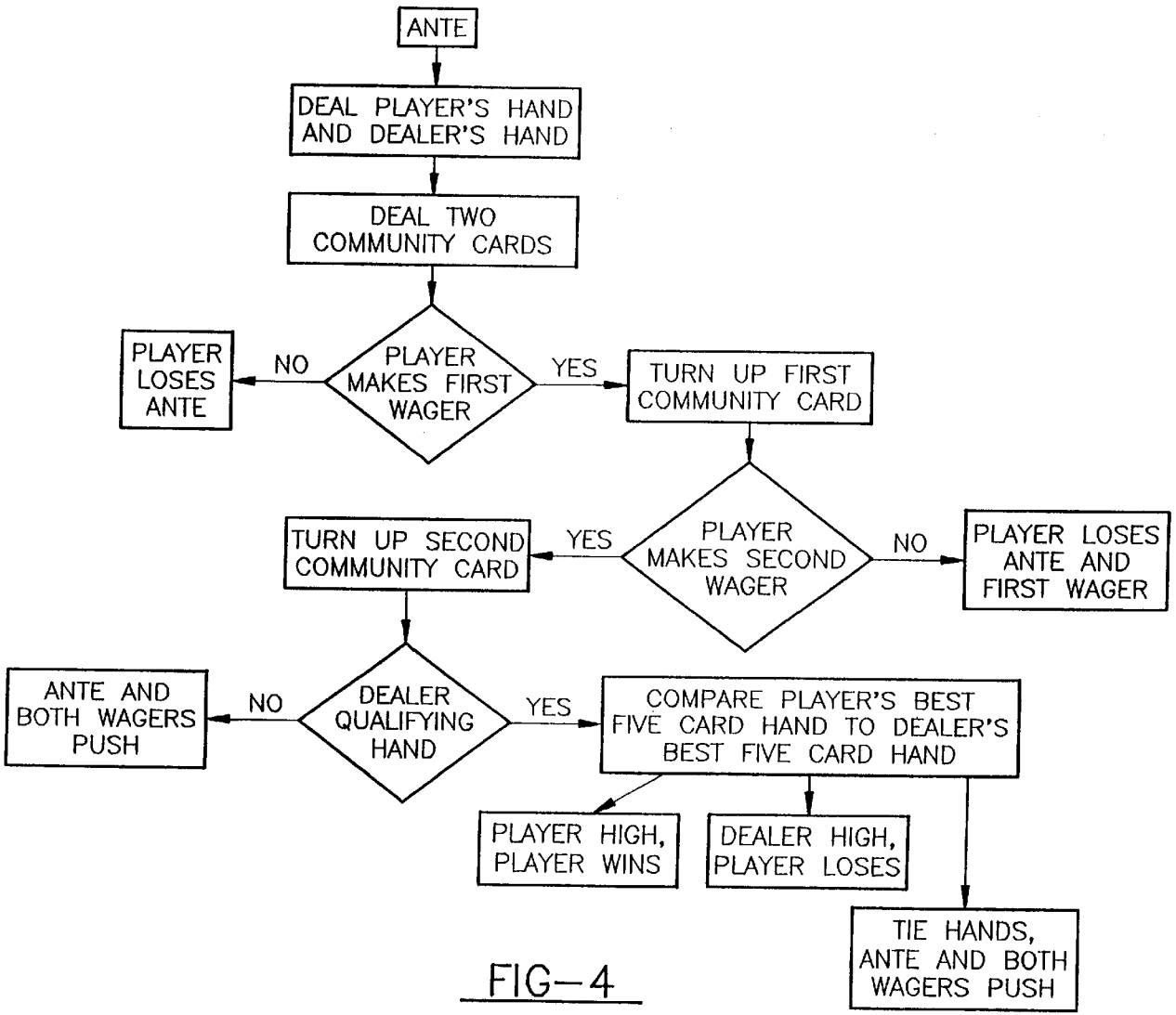

The seven card stud poker game is preferably played at a gaming table layout of the type shown generally at 10 in FIG. 1. A plurality of player positions 20 are located around the periphery of a semi-circular gaming table of the type used for live table gaming, such as a Twenty-One table. Each player position 20 has a wagering location 30 associated therewith, the details of each wagering location being shown in FIG. 2.

Each wagering position includes a "player cards" area 32 and three wagering areas—the "ante" spot 34, the "first" wager spot 36 and the "second" wager spot 38. Also included at each wagering location is the "jackpot" wager location 40 which is used by the player to make a side wager to be eligible for the "bad beat" feature of the method of play. Any suitable device can be used for the "jackpot" wager location 40 such as a slot in the surface of the gaming table to receive the side wager for the "bad beat" feature. An illumination device 42, such as an LED, can be associated with the slot to show that the player at that position has made a side wager to be eligible for the "bad beat" feature. A typical apparatus that can be used for the side wager is shown in U.S. Pat. No. 5,078,045, which is incorporated herein by this reference.

Referring again to FIG. 1, also positioned at a suitable location on the gaming table is a progressive meter sign 50 that shows the current amount of the progressive jackpot that is available to be won by a lucky player. Also optionally associated with the gaming table 10 is a card shuffling device 60 for shuffling the cards prior to each deal.

The gaming table layout also has a dealer position located adjacent to the chip rack 70 which is conventional. The dealer location also includes a location 80 for displaying the dealer's first five cards. Positioned adjacent the location 80 are two additional card positions, the "turn" card position 82 and the "river" card position 84, the use of which will be described below.

The method of play of the present invention proceeds as follows:

Each player makes an initial ante wager to be eligible to play the game. The player places his ante wager amount in the "ante" spot 34 on the gaming table layout. Each player also has the option to make a side bet wager to be eligible for the "bad beat" feature. The player makes this side bet wager by placing a gaming token in the slot 40 at his player position. When the gaming token is inserted into the slot 40, the LED 42 lights up to show that the player has made the side bet wager.

After each player has made his ante wager and his side bet wager, the dealing of the cards begins. Using a standard deck of fifty-two playing cards which have been shuffled in any conventional manner, the dealer deals five cards to each player and five cards to the dealer's position. The deal can be performed in any suitable manner such as one card at a time to each player followed by a card to the dealer's position until all five cards have been dealt. Alternatively, each player can be dealt all five cards at once, proceeding around the table until all players have been dealt their five cards and then the dealer's position receives its five cards. The deal is preferably performed from the dealer's left-to-right around the table, as in conventional, but any direction of the deal can be used.

Each player receives his cards face down and the dealer's cards are placed face down at the dealer position. Finally, two other face down cards are dealt and placed at the "turn" position 82 and the "river" position 84, respectively. Each player looks at his cards and decides whether to proceed with the game. The dealer's cards remain face down on the table layout at the location 80.

After looking at his five cards, each player must then decide whether to fold and lose his ante or continue to play by making another wager which is placed in the "first" wager spot 36 at the player location. After all players have either folded or made the "first" wager, the "turn" card 82 is revealed.

Each player must then decide whether to fold and lose his ante wager and his first wager, or to continue playing by making another wager, which is placed in the "second" wager spot 38 at the player location. After all players have either folded or made the "second" wager, the "river" card 84 is revealed, At this time, also, all of the dealer's initial five cards are turned face up.

Both the "turn" card 82 and the "river" card 84 are community cards that are used by each player and the dealer. Thus each player and the dealer have seven card stud poker hands from which the best five cards are used to make the highest ranking poker hand possible. Conventional poker hand rankings are used.

Before each player's hand is compared to the dealer's hand, each player's hand is analyzed to see if the player has a minimum qualifying hand. In order for the player's hand to qualify, the player must have a minimum ranking hand which is to be determined mathematically. In the preferred embodiment of the present invention, the minimum ranking poker hand for qualifying will be at least a pair of Deuces or better in the seven cards used in the player's hand. Alternatively, other lower or higher ranking poker hands can be used as the minimum qualifying poker hand ranking for the player's hand to qualify.

If the player does not have a minimum qualifying hand, all wagers (except the side bet wager) made by each player are lost to the gaming establishment including the "ante" wager, the "first" wager and the "second" wager.

If the player does qualify, all cards of each player's hand are turned face up and each player's hand is compared to the dealer's hand to determined whether the player's hand has a higher ranking five card poker hand than the dealer's hand. The two community cards are used in all hands to determine each hand's best five card poker hand ranking. Conventional poker hand rankings are used to determine the higher hand: Royal Flush, Straight Flush, Four-of-a-Kind, Full House, Flush, Straight, Three-of-a-Kind, Two Pair and One Pair.

As an alternative to using a player hand qualification, a dealer hand qualification may be used. In this variation, before each player's hand is compared to the dealer's hand, the dealer's hand is analyzed to see if the dealer has a minimum qualifying hand. In order for the dealer's hand to qualify, the dealer must have a minimum ranking hand which is to be determined mathematically. In the preferred embodiment of the present invention, the minimum ranking poker hand for qualifying will be at least a pair of Jacks or better in the seven cards used in the dealer's hand. Alternatively, other lower or higher ranking poker hands can be used as the minimum qualifying poker hand ranking for the dealer's hand to qualify.

If the dealer does not have a minimum qualifying hand, all wagers (except the side bet wager) made by each player are considered pushes and returned to the player including the "ante" wager, the "first" wager and the "second" wager.

If the dealer does qualify, the game continues, All cards of each player's hand are turned face up and each player's hand is compared to the dealer's hand to determined whether the player's hand has a higher ranking five card poker hand than the dealer's hand. The two community cards are used in all hands to determine each hand's best five card poker hand ranking. Conventional poker hand rankings are used to determine the higher hand: Royal Flush, Straight Flush, Four-of-a-Kind, Full House, Flush, Straight, Three-of-a-Kind, Two Pair and One Pair.

In either variation, if the dealer's hand wins, all wagers made by the player are lost (subject to the "bad beat" feature to be explained below). If the player's hand wins, the player wins one-to-one odds on each of his wagers—the "ante" wager, the "first" wager and the "second" wager. If the player's hand loses, the player loses all of his three wagers. If the player's hand and the dealer's hand tie, then all of the player's wagers are a push and all of the player's wagers are returned to the player.

After winning and losing player's hands are determined, the outcome of the side bet for either winning poker hand combinations or for the "bad beat" feature is considered. In order to be eligible to possibly win either one of these side bet payouts, the player must have made the side bet wager at the beginning of the play of the hand. When the player has made this side bet wager, the player is said to be "jackpot qualified." Additionally, the player must also have a "non-folded" hand, i.e. the player must have made all three wagers—the "ante" wager, the "first" wager and the "second" wager.

In the preferred embodiment of the present invention, the side bet wager will be in the amount of $1.00, but the method of play of the present invention can be adapted to any amount used as the side bet wager. In the preferred embodiment of the present invention, a percentage of each side bet wager is added to a progressive jackpot amount that is available to be won by the player who has a high ranking poker hand or when the player suffers a "bad beat". It is also contemplated that the progressive jackpot will be initially seeded at a suitable beginning level amount, for example $100,000.00.

If the player is "jackpot qualified", then the player is eligible to win additional payouts on the poker hand ranking of his best five card hand. If the player's hand beats or ties the dealer's hand and the player's hand comprises at least a Four-of-a-Kind or better, then the player wins a payout based on the amount of the player's side bet. Table 1 shows a representative pay table for a $1.00 side bet wager for certain high ranking poker hands achieved by the player.

The other side bet for which the player is eligible when he is "jackpot qualified is the "bad beat" feature. The "bad beat" feature involves the situation in which the player has a high ranking poker hand and loses to the dealer's higher ranking poker hand.

If the player is "jackpot qualified" and loses to the dealer's hand and the player has a losing poker hand of one of certain predetermined poker hand rankings, the player wins a "bad beat" payoff based on the amount of the player's side bet wager, such as the $1.00 preferred wager. Although any predetermined poker hand rankings can be used for a consideration of the "bad beat" feature, in the preferred embodiment of the present invention, to be eligible for a "bad beat" payoff, the player must have at least a Straight and the player must lose to the dealer because the dealer has a poker hand with a ranking higher than the player's hand.

Table 1 shows a representative payout table that can be used for high ranking poker hands when the player wins or ties the dealer or when the player suffers a "bad beat" hand based on a $1.00 side bet wager.

TABLE 1

| Poker Hand Ranking | Win/Tie | "Bad Beat" |
|---|---|---|
| Royal Flush | $1,000 | N/A |
| Straight Flush | $200 | $500,000 |
| Four of a Kind (Aces thru Tens) | $100 | $100,000 |
| Four of a Kind (Nines thru Twos) | $50 | $50,000 |
| Full House | Lose | $500 |
| Flush | Lose | $100 |

TABLE 1-continued

| Poker Hand Ranking | Win/Tie | "Bad Beat" |
|---|---|---|
| Straight | Lose | $50 |
| Other | Lose | Lose |

Other pay tables can be used with various winning amounts and poker hand ranking combinations.

For example, if the player has a Straight and loses to the dealer, the player is paid fifty times the amount of the player's side bet wager ($50 for a $1 side bet wager). Similarly, the player is paid one hundred times the amount of the player's side bet wager for a Flush "bad beat" loser and five hundred times the amount of the player's side bet wager for a Full House "bad beat" loser all the way up to five hundred thousand times the amount of the player's side bet wager for a Straight Flush "bad beat" loser.

As an additional feature of the present invention, in certain "bad beat" wager winning situations, all other players at the table who have also made the side bet wager will share in the amount of the "bad beat" winnings with the player who had the "bad beat" losing hand winning the major portion of the winnings.

The "bad beat" feature of the present invention, while described above in connection with a seven card stud game, can also be applied to other casino games, both live table games and electronic video games and slot machines. In each of the following examples, it is assumed that the player has a made an additional side bet wager to be eligible for the "bad beat" payoffs.

In conventional video poker games which typically only use a single player's hand to determine winning and losing plays, a dealer's hand can be added to the method of play to provide a situation in which the player can suffer a "bad beat". For example, if the player achieves at least a Flush hand, and the dealer's hand is a higher hand, the player can be awarded a "bad beat" payoff.

In a Craps game, a "bad beat" proposition could be provided for a player based on having made a point and then losing the point (Crapping Out) a pre-established number of times in a row, for example, five times in a row.

In a Twenty-One game, a "bad beat" proposition could be provided if the dealer has a Blackjack of the Ace of Spades and the King of Spades and the player has a Blackjack consisting of an Ace and a King suited of the three suits other than Spades.

In a Roulette game, a "bad beat" proposition could be provided for the roulette ball landing on "0" or "00" three times in succession.

In a slot machine, a "bad beat" payoff could be made if the highest winning symbol on the slot machine is aligned on each reel immediately above (or below) the pay line.

In a Keno game, the player would be paid a "bad beat" payoff if the player fails to hit a single number on a five game ticket having at least six spots marked.

In a Bingo game, the player would be paid a "bad beat" payoff if the player has less than six numbers hit on his bingo card during a coverall (or blackout) game.

The method of the present invention has been described in connection with a live casino table game. The invention may also be practiced using an electronic gaming machine programmed to display the method of play on a video screen.

While the invention has been illustrated with respect to several specific embodiments thereof, these embodiments should be considered as illustrative rather than limiting. Various modifications and additions may be made and will be apparent to those skilled in the art. Accordingly, the invention should not be limited by the foregoing description, but rather should be defined only by the following claims.

What is claimed is:

1. A method of playing a card game in which at least one player competes against a dealer comprising:

a) the player making a first ante wager to be eligible to play the card game;

b) dealing five cards to the player comprising the player's hand;

c) dealing five cards to dealer comprising the dealer's hand;

d) dealing a first community card and a second community card, both cards being dealt face down;

e) the player either folding and losing his ante wager or making a first wager to continue playing the card game;

f) turning face up the first community card;

g) the player either folding and losing his ante wager and first wager or making a second wager to continue playing the card game;

h) turning face up the second community card;

i) determining whether the player has a qualifying hand by examining the five cards in the player's hand with the two community cards;

j) if the player does not have a qualifying hand, the player loses all of the player's wagers;

k) if the player does have a qualifying hand, determining the best five card poker hand ranking of the player's hand from the five cards of the player's hand and the two community cards;

l) determining the best five card poker hand ranking of the dealer's hand from the five cards of the dealer's hand and the two community cards;

m) declaring the winner to be the higher poker ranking hand between the player's best five card poker hand and the dealer's five card poker hand;

n) if the player's hand is the winner, paying the player a pre-established amount based on the total amount of the player's wagers;

o) if the dealer's hand is the winner, the player loses the total amount of the player's wagers; and p) if the dealer's hand and the player's hand tie, returning the total amount of the player's wagers to the player.

2. The method of claim 1 in which the player's hand must have a poker hand ranking of a pair of Deuces or better to be a qualifying hand.

3. The method of claim 1 in which the pre-established amount is one-to-one odds.

4. The method of claim 1 further including:

a) the player making a side bet wager to be eligible for at least one special payout;

b) if the player has also made the ante wager, the first wager and the second wager and the player has a predetermined high ranking poker hand and the player has a winning hand, the player is awarded a first special payout based on the amount of the player's side bet wager.

5. The method of claim 4 in which the predetermined high ranking poker hand is a Four-of-a-Kind or higher.

6. The method of claim 5 in which the first special payout is according to the following pay table:

| Poker Hand Ranking | Win/Tie |
|---|---|
| Royal Flush | $1,000 |
| Straight Flush | $200 |
| Four of a Kind (Aces thru Tens) | $100 |
| Four of a Kind (Nines thru Twos) | $50 |
| Other | Lose. |

7. The method of claim 1 further including:

a) the player making a side bet wager to be eligible for at least one special payout;

b) if the player has also made the ante wager, the first wager and the second wager and the player has a predetermined high ranking poker hand but the player has a losing hand, the player is awarded a second special payout based on the amount of the player's side bet wager.

8. The method of claim 7 in which the predetermined high ranking poker hand is a Straight or higher.

9. The method of claim 8 in which the first special payout is according to the following pay table:

| Poker Hand Ranking | "Bad Beat" |
|---|---|
| Royal Flush | N/A |
| Straight Flush | $500,000 |
| Four of a Kind (Aces thru Tens) | $100,000 |
| Four of a Kind (Nines thru Twos) | $50,000 |
| Full House | $500 |
| Flush | $100 |
| Straight | $50 |
| Other | Lose. |

10. A method of playing a card game in which at least one player competes against a dealer comprising:

a) the player making a first ante wager to be eligible to play the card game;

b) dealing five cards to the player comprising the player's hand;

c) dealing five cards to dealer comprising the dealer's hand;

d) dealing a first community card and a second community card, both cards being dealt face down;

e) the player either folding and losing his ante wager or making a first wager to continue playing the card game;

f) turning face up the first community card;

g) the player either folding and losing his ante wager and first wager or making a second wager to continue playing the card game;

h) turning face up the second community card;

determining whether the dealer has a qualifying hand by examining the five cards in the dealer's hand with the two community cards;

j) if the dealer does not have a qualifying hand, the player pushes on all of the player's wagers;

k) if the dealer does have a qualifying hand, determining the best five card poker hand ranking of the player's hand from the five cards of the player's hand and the two community cards;

l) determining the best five card poker hand ranking of the dealer's hand from the five cards of the dealer's hand and the two community cards;

m) declaring the winner to be the higher poker ranking hand between the player's best five card poker hand and the dealer's five card poker hand;

n) if the player's hand is the winner, paying the player a pre-established amount based on the total amount of the player's wagers;

o) if the dealer's hand is the winner, the player loses the total amount of the player's wagers; and p) if the dealer's hand and the player's hand tie, returning the total amount of the player's wagers to the player.

11. The method of claim 10 in which the dealer's hand must have a poker hand ranking of a pair of Jacks or better to be a qualifying hand.

12. The method of claim 10 in which the pre-established amount is one-to-one odds.

13. The method of claim 10 further including:

a) the player making a side bet wager to be eligible for at least one special payout;

b) if the player has also made the ante wager, the first wager and the second wager and the player has a predetermined high ranking poker hand and the player has a winning hand, the player is awarded a first special payout based on the amount of the player's side bet wager.

14. The method of claim 13 in which the predetermined high ranking poker hand is a Four-of-a-Kind or higher.

15. The method of claim 14 in which the first special payout is according to the following pay table:

| Poker Hand Ranking | Win/Tie |
|---|---|
| Royal Flush | $1,000 |
| Straight Flush | $200 |
| Four of a Kind (Aces thru Tens) | $100 |
| Four of a Kind (Nines thru Twos) | $50 |
| Other | Lose. |

16. The method of claim 10 further including:

a) the player making a side bet wager to be eligible for at least one special payout;

b) if the player has also made the ante wager, the first wager and the second wager and the player has a predetermined high ranking poker hand but the player has a losing hand, the player is awarded a second special payout based on the amount of the player's side bet wager.

17. The method of claim 16 in which the predetermined high ranking poker hand is a Straight or higher.

18. The method of claim 17 in which the first special payout is according to the following pay table:

| Poker Hand Ranking | "Bad Beat" |
|---|---|
| Royal Flush | N/A |
| Straight Flush | $500,000 |
| Four of a Kind (Aces thru Tens) | $100,000 |
| Four of a Kind (Nines thru Twos) | $50,000 |
| Full House | $500 |
| Flush | $100 |
| Straight | $50 |
| Other | Lose. |

* * * * *